US007757792B2

(12) United States Patent
Shamburger

(10) Patent No.: US 7,757,792 B2
(45) **Date of Patent: *Jul. 20, 2010**

(54) METHOD AND APPARATUS FOR SELECTIVELY LEACHING PORTIONS OF PDC CUTTERS ALREADY MOUNTED IN DRILL BITS

(75) Inventor: James Shamburger, Spring, TX (US)

(73) Assignee: OMNI IP Ltd

( * ) Notice: Subject to any disclaimer, the term of this patent is extended or adjusted under 35 U.S.C. 154(b) by 0 days.

This patent is subject to a terminal disclaimer.

(21) Appl. No.: 12/218,829

(22) Filed: Jul. 18, 2008

(65) Prior Publication Data

US 2010/0012390 A1 Jan. 21, 2010

(51) Int. Cl.
*E21B 10/36* (2006.01)
*B32B 15/04* (2006.01)

(52) U.S. Cl. ..... 175/434; 175/426; 51/307; 51/309; 428/408; 428/457; 428/698

(58) Field of Classification Search ..... 175/426, 175/434; 51/307, 309; 76/108.1, 108.2, 76/108.4; 428/408, 421, 422, 457, 523, 698
See application file for complete search history.

(56) References Cited

U.S. PATENT DOCUMENTS

| | | | | |
|---|---|---|---|---|
| 4,943,488 | A | 7/1990 | Sung | |
| 6,450,271 | B1 * | 9/2002 | Tibbitts et al. | 175/374 |
| 6,601,662 | B2 | 8/2003 | Matthias et al. | |
| 6,739,214 | B2 | 5/2004 | Griffin et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 7,435,478 | B2 | 10/2008 | Keshavan | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,575,805 | B2 | 8/2009 | Achilles et al. | |
| 7,608,333 | B2 | 10/2009 | Eyre | |
| 2002/0029909 | A1 | 3/2002 | Griffo | |
| 2006/0060391 | A1 | 3/2006 | Eyre et al. | |
| 2007/0039762 | A1 | 2/2007 | Achilles | |
| 2007/0144790 | A1 | 6/2007 | Fang | |
| 2007/0169419 | A1 * | 7/2007 | Davis et al. | 51/293 |
| 2007/0181747 | A1 | 8/2007 | Byrd | |
| 2007/0284152 | A1 | 12/2007 | Eyre | |
| 2008/0073126 | A1 | 3/2008 | Shen | |

FOREIGN PATENT DOCUMENTS

| | | | |
|---|---|---|---|
| EP | 1190791 | A2 | 3/2002 |
| WO | 2007148060 | A1 | 12/2007 |

* cited by examiner

*Primary Examiner*—David J Bagnell
*Assistant Examiner*—Catherine Loikith
(74) *Attorney, Agent, or Firm*—The Matthews Firm

(57) ABSTRACT

A polycrystalline diamond compact (PDC) drill bit having a plurality of PDC cutters, each having a body of diamond crystals containing catalyzing material, is coated with a material which is impervious to a given acid. After the coating is dried, a segment of the coating is removed and acid is supplied to the body of diamond crystals to leach out the catalyzing material contained within the exposed portion of the body.

16 Claims, 9 Drawing Sheets

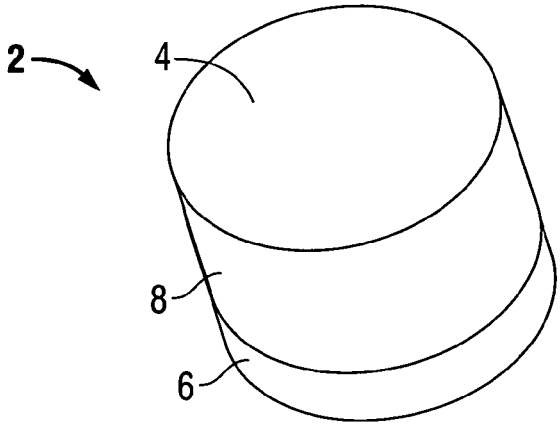
FIG.
(Prior Art)1
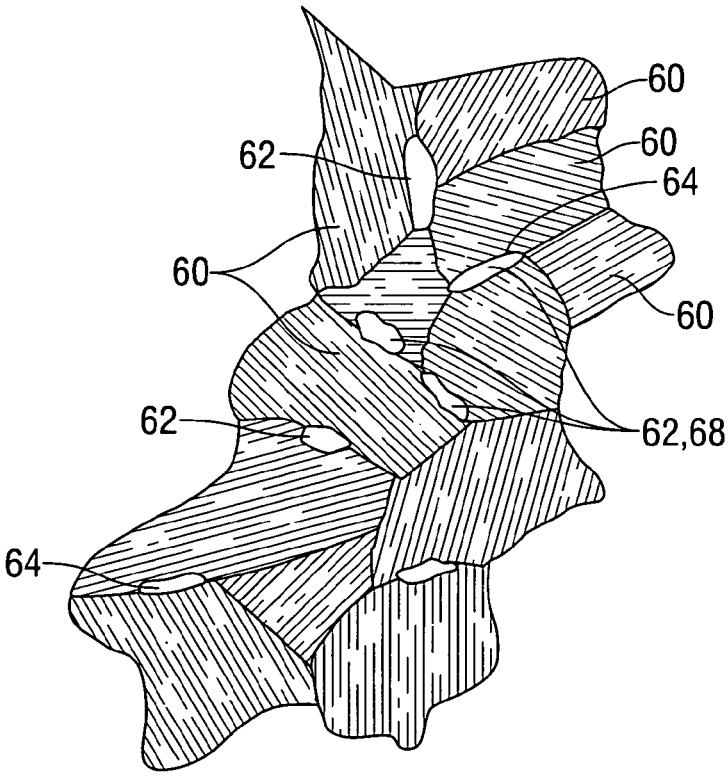
FIG. 2

METHOD AND APPARATUS FOR SELECTIVELY LEACHING PORTIONS OF PDC CUTTERS ALREADY MOUNTED IN DRILL BITS

BACKGROUND OF INVENTION

1. Field of the Invention

The invention relates to superhard polycrystalline material elements for wear, cutting, drawing, and other applications where engineered superhard surfaces are needed. The invention particularly relates to polycrystalline diamond compacts (collectively called PDC) cutting elements with greatly improved wear resistance and methods of manufacturing them.

2. Description of Related Art

Polycrystalline diamond and polycrystalline diamond-like elements are known, for the purposes of this specification, as PDC elements. PDC elements are formed from carbon based materials with exceptionally short inter-atomic distances between neighboring atoms. One type of polycrystalline diamond-like material is known as carbonitride (CN) described in U.S. Pat. No. 5,776,615. Another, more commonly used form of PDC is described in more detail below. In general, PDC elements are formed from a mix of materials processed under high-temperature and high-pressure into a polycrystalline matrix of inter-bonded superhard carbon based crystals. A common trait of PDC elements is the use of catalyzing materials during their formation, the residue from which, often imposes a limit upon the maximum useful operating temperature of the element while in service.

A well known, manufactured form of PDC element is a two-layer or multi-layer PDC element where a facing table of polycrystalline diamond is integrally bonded to a substrate of less hard material, such as tungsten carbide. The PDC element may be in the form of a circular or part-circular tablet, or may be formed into other shapes, suitable for applications such as hollow dies, heat sinks, friction bearings, valve surfaces, indentors, tool mandrels, etc. PDC elements of this type may be used in almost any application where a hard wear and erosion resistant material is required. The substrate of the PDC element may be brazed to a carrier, often also of cemented tungsten carbide. This is a common configuration for PDC's used as cutting elements, for example in fixed cutter or rolling cutter earth boring bits when received in a socket of the drill bit, or when fixed to a post in a machine tool for machining.

Another form of PDC element is a unitary PDC element without an integral substrate where a table of polycrystalline diamond is fixed to a tool or wear surface by mechanical means or a bonding process. These PDC elements differ from those above in that diamond particles are present throughout the element. These PDC elements may be held in place mechanically, they may be embedded within a larger PDC element that has a substrate, or, alternately, they may be fabricated with a metallic layer which may be bonded with a brazing or welding process. A plurality of these PDC elements may be made from a single PDC, as shown, for example, in U.S. Pat. Nos. 4,481,016 and 4,525,179 herein incorporated by reference.

PDC elements are most often formed by sintering diamond powder with a suitable binder-catalyzing material in a high-pressure, high-temperature press. One particular method of forming this polycrystalline diamond is disclosed in U.S. Pat. No. 3,141,746 herein incorporated by reference. In one common process for manufacturing PDC elements, diamond powder is applied to the surface of a preformed tungsten carbide substrate incorporating cobalt. The assembly is then subjected to very high temperature and pressure in a press. During this process, cobalt migrates from the substrate into the diamond layer and acts as a binder-catalyzing material, causing the diamond particles to bond to one another with diamond-to-diamond bonding, and also causing the diamond layer to bond to the substrate.

The completed PDC element has at least one matrix of diamond crystals bonded to each other with many interstices containing a binder-catalyzing material metal as described above. The diamond crystals comprise a first continuous matrix of diamond, and the interstices form a second continuous matrix of interstices containing the binder-catalyzing material. In addition, there are necessarily a relatively few areas where the diamond to diamond growth has encapsulated some of the binder-catalyzing material. These "islands" are not part of the continuous interstitial matrix of binder-catalyzing material.

In one common form, the diamond element constitutes 85 % to 95 % by volume and the binder-catalyzing material the other 5 % to 15 %. Such an element may be subject to thermal degradation due to differential thermal expansion between the interstitial cobalt binder-catalyzing material and diamond matrix beginning at temperatures of about 400 degrees C. Upon sufficient expansion the diamond-to-diamond bonding may be ruptured and cracks and chips may occur. Also in polycrystalline diamond, the presence of the binder-catalyzing material in the interstitial regions adhering to the diamond crystals of the diamond matrix leads to another form of thermal degradation. Due to the presence of the binder-catalyzing material, the diamond is caused to graphitize as temperature increases, typically limiting the operation temperature to about 750 degrees C.

Although cobalt is most commonly used as the binder-catalyzing material, any group VIII element, including cobalt, nickel, iron, and alloys thereof, may be employed.

To reduce thermal degradation, so-called "thermally stable" polycrystalline diamond components have been produced as preform PDC elements for cutting and/or wear resistant elements, as disclosed in U.S. Pat. No. 4,224,380 herein incorporated by reference. In one type of thermally stable PDC element the cobalt or other binder-catalyzing material in conventional polycrystalline diamond is leached out from the continuous interstitial matrix after formation. While this may increase the temperature resistance of the diamond to about 1200 degrees C., the leaching process also removes the cemented carbide substrate. In addition, because there is no integral substrate or other bondable surface, there are severe difficulties in mounting such material for use in operation.

The fabrication methods for this "thermally stable" PDC element typically produce relatively low diamond densities, of the order of 80 % or less. This low diamond density enables a thorough leaching process, but the resulting finished part is typically relatively weak in impact strength.

In an alternative form of thermally stable polycrystalline diamond, silicon is used as the catalyzing material. The process for making polycrystalline diamond with a silicon catalyzing material is quite similar to that described above, except that at synthesis temperatures and pressures, most of the silicon is reacted to form silicon carbide, which is not an effective catalyzing material. The thermal resistance is somewhat improved, but thermal degradation still occurs due to some residual silicon remaining, generally uniformly distributed in the interstices of the interstitial matrix. Again, there are mounting problems with this type of PDC element because there is no bondable surface.

More recently, a further type of PDC has become available in which carbonates, such as powdery carbonates of Mg, Ca, Sr, and Ba are used as the binder-catalyzing material when sintering the diamond powder. PDC of this type typically has greater wear-resistance and hardness than the previous types of PDC elements. However, the material is difficult to produce on a commercial scale since much higher pressures are required for sintering than is the case with conventional and thermally stable polycrystalline diamond. One result of this is that the bodies of polycrystalline diamond produced by this method are smaller than conventional polycrystalline diamond elements. Again, thermal degradation may still occur due to the residual binder-catalyzing material remaining in the interstices. Again, because there is no integral substrate or other bondable surface, there are difficulties in mounting this material to a working surface.

Efforts to combine thermally stable PDCs with mounting systems to put their improved temperature stability to use have not been as successful as hoped due to their low impact strength. For example, various ways of mounting multiple PDC elements are shown in U.S. Pat. Nos. 4,726,718; 5,199,832; 5,025,684; 5,238,074; 6,009,963 herein incorporated by reference. Although many of these designs have had commercial success, the designs have not been particularly successful in combining high wear and/or abrasion resistance while maintaining the level of toughness attainable in non-thermally stable PDC.

Other types of diamond or diamond like coatings for surfaces are disclosed in U.S. Pat. Nos. 4,976,324; 5,213,248; 5,337,844; 5,379,853; 5,496,638; 5,523,121; 5,624,068 all herein incorporated by reference for all they disclose. Similar coatings are also disclosed in GB Patent Publication No. 2,268,768, PCT Publication No. 96/34,131, and EPC Publications 500,253; 787,820; 860,515 for highly loaded tool surfaces. In these publications, diamond and/or diamond like coatings are shown applied on surfaces for wear and/or erosion resistance.

In many of the above applications physical vapor deposition (PVD) and/or chemical vapor deposition (CVD) processes are used to apply the diamond or diamond like coating. PVD and CVD diamond coating processes are well known and are described for example in U.S. Pat. Nos. 5,439,492; 4,707,384; 4,645,977; 4,504,519; 4,486,286 all herein incorporated by reference.

PVD and/or CVD processes to coat surfaces with diamond or diamond like coatings may be used, for example, to provide a closely packed set of epitaxially oriented crystals of diamond or other superhard crystals on a surface. Although these materials have very high diamond densities because they are so closely packed, there is no significant amount of diamond to diamond bonding between adjacent crystals, making them quite weak overall, and subject to fracture when high shear loads are applied. The result is that although these coatings have very high diamond densities, they tend to be mechanically weak, causing very poor impact toughness and abrasion resistance when used in highly loaded applications such as with cutting elements, bearing devices, wear elements, and dies.

Some attempts have been made to improve the toughness and wear resistance of these diamond or diamond like coatings by application to a tungsten carbide substrate and subsequently processing in a high-pressure, high-temperature environment as described in U.S. Pat. Nos. 5,264,283; 5,496,638; 5,624,068 herein incorporated by reference for all they contain. Although this type of processing may improve the wear resistance of the diamond layer, the abrupt transition between the high-density diamond layer and the substrate make the diamond layer susceptible to wholesale fracture at the interface at very low strains. This translates to very poor toughness and impact resistance in service.

When PDC elements made with a cobalt or other group VIII metal binder-catalyzing material were used against each other as bearing materials, it was found that the coefficient of friction tended to increase with use. As described in European Patent specification number 617,207, it was found that removal (by use of a hydrochloric acid wipe) of the cobalt-rich tribofilm which tended to build up in service from the surface of the PDC bearing element, tended to mitigate this problem. Apparently, during operation, some of the cobalt from the PDC at the surface migrates to the load area of the bearing, causing increased friction when two PDC elements act against each other as bearings. It is now believed that the source of this cobalt may be a residual by-product of the finishing process of the bearing elements, as the acid wipe remedy cannot effectively remove the cobalt to any significant depth below the surface.

Because the cobalt is removed only from the surface of the PDC, there is no effective change in the temperatures at which thermal degradation occurs in these bearing elements. Therefore the deleterious effects of the binder-catalyzing material remain, and thermal degradation of the diamond layer due to the presence of the catalyzing material still occurs.

There have also been attempts in this art to use traditional leaching methods to solve the problem that describes to make them more temperature resistant. These traditional leaching methods have involved the leaching of the entire diamond table or a majority of it.

The traditional leaching method involves the use of highly concentrated acids, such as nitric, sulfuric and/or hydrofluoric, raised to near the boiling points of such acids. In such process, the PDC cutters are placed in a bath of one of these acids diamond side down. These attempts in the prior art treat the entire diamond surface or the biggest part of it. These attempts are shown in U.S. Pat. Nos. 6,739,214, 6,592,985, 6,749,033, 6,797,326, 6,562,462, 6,585,064 and 6,589,640. The same technology, having the same shortcomings, is found in U.S. Pat. No. 4,224,380 to Bovenkirk, et al., assigned to General Electric, and Published Japanese Patent Application Number 85-91691, assigned to Sumitomo. These patents typically designate specific leaching depths and all these patents address treating the entire compact, or are based on depth from the face of the diamond surface. Thus, when the cutters are exposed to the heated acid, the acid itself will remove the cobalt in the interstices of the matrix which is proposed to make them less likely to fail due to high temperatures. The problem with this approach, is that when the cobalt or other metal is removed from the interstices of the matrix, the material is not as strong mechanically and can cause the cutters to break off. The only reason the cobalt is formed in the matrix in the first place is to make them more mechanically stable but when that portion of the cobalt or other metal is removed, the cutters become less impact resistant and thus less mechanically stable. When drilling a hole with a PDC bit having PDC cutters, such as used in drilling in oil and gas well, only the repeat downward oriented edge of any PDC cutter is doing the cutting work. In general, maintaining the integrity of this sharp drilling edge is the focus of the leaching treatment. Because the cutters are round, typically, and their installation as to orientation is uncertain, those in this art have leached the entire PDC layer. Yet, when this drilling edge is worn down by abrasive formations, those full face leaching cutters sometimes fail nearly as rapidly as the non-leached cutters due to heat generation on the large wear flat of the PDC cutter. These prior cutters are also more fragile with respect to impact than the non-leached cutters, all as discussed hereinabove.

Each of the U.S. Pat. Nos. 6,739,214; 6,592,985; 6,749,033; 6,797,326; 6,562,462; 6,585,064; 6,589,640; 4,224,380 (Bovenkirk, et al) and Published Japanese Application Number 95-91691 (Sumitomo) are incorporated herein by reference for what they disclose. However, each of these references disclose leaching of the metallic phase, typically cobalt, commencing with the entire face of the diamond surface, coupled with a continued leaching of the cobalt over a depth range of 100 or 200 microns from the face up through and sometimes including the entirety of the diamond compact.

The depth of the acid leaching process is a function of many factors. These factors include the following items, and for any given acid leaching process, some or all of these elements may or many not be involved:

- The nature of the metallic phase; this will often involve cobalt but other known metallic components can be, and are used in the manufacturing process of constructing polycrystalline diamond compact cutters for use in drill bits;
- The extent to which the diamond crystals themselves are "finer" in size; some PDC cutter manufacturers use "fine" diamond crystals, for example, US Synthetic Corporation and E6, a DeBeers Company. Each use fine diamond crystals in making PDC cutters. As a general rule, the finer crystals have smaller interstitial spaces between the crystals, resulting in a smaller amount of cobalt to be leached out.
- The chemical composition of the acid used in the leaching process; the most common acids used in this process are hydrochloric acid, nitric acid, hydrofluoric acid, sulfuric acid and various mixes thereof; some of these acids are more aggressive than others in leaching a given metallic phase, and the volumetric ratio of one acid to one or the other acids also effects the aggression of the acids used in the leaching process;
- The temperature of the acid used in the leaching process; as a general rule, the acids used are more aggressive when used at or near their respective boiling points;
- The time of exposure of the metallic phase to the leaching acid; everything else being equal, the elapsed time of exposure is the most important factor in determining the depth of the leaching process.

For example, in the '380 patent to (Bovenkirk) et al, selected samples were leached in a mixture of hydrofluoric acid and nitric acid taking between eight and twelve days to entirely remove the metallic phase.

With a second set of samples, the hydrofluoric acid-nitric acid was alternated with aqua regia (hydrochloric acid-nitric acid) for a period of three to six days, removing entirely the metallic phase. Thus the other factors above set forth determine the rate at which the depth of leaching occurs and the depth of leaching is only a function of time. Assuming the rate of leaching is determined by specifying the acid mix, the operating temperature of the acid mix, the diamond particle size, the given metallic phase, e.g. cobalt, the depth of leaching is determined to be X microns of depth per hour. In Y hours the depth of leaching is merely XY microns.

From a practical standpoint, in truly abrasive rock formations, full face leached cutters also wear and the wear flat is usually large enough that the PDC cannot be rotated for repair. This results in the cutter being essentially useless even though it has an expensive chemical treatment across the entire diamond table. This results in portions of each cutter that are never used due to large wear flat development, a development which often extends into the cutter pocket in highly abrasive formations. The present invention contemplates that only a selected portion or portions of the PDC cutter are leached.

BRIEF DESCRIPTION OF THE DRAWINGS

FIG. 1 is an isomeric, pictorial view of a known PDC cutter;

FIG. 2 is a cutaway illustration of a portion of the diamond crystal structure used in a PDC cutter;

DETAILED DESCRIPTION OF THE PREFERRED EMBODIMENT

Figure 3:
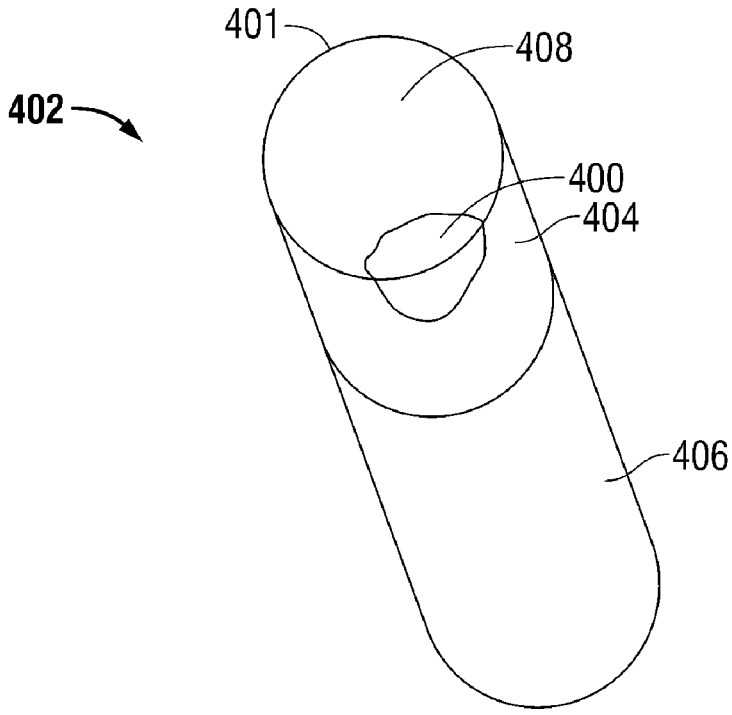
FIG. 3 is an isomeric, pictorial view of a PDC cutter having a segment of the cutting edge exposed to a leaching acid according to the invention.

The polycrystalline diamond or compact (PDC) element 2 of the present invention is shown in FIG. 1. The PDC element 2 has a plurality of partially bonded superhard, diamond or diamond-like, crystals 60, (shown in FIGS. 2 and 4), a catalyzing material 64, and an interstitial matrix 68 formed by the interstices 62 among the crystals 60. The element 2 also has one or more working surfaces 4 and the diamond crystals 60 and the interstices 62 form the volume of the body 8 of the PDC element 2.

It has been known for some number of years to leach PDC cutters to remove the cobalt (the metallic phase) of a PDC cutter matrix by immersing portions of the cutter into an acid solution. This is typified by the above-referenced patents, and earlier, by the Sumotomo Japanese patent publication and by the General Electric patent. The present invention contemplates the use of drill bits which already have in place the PDC cutters, for example, by brazing or otherwise the cutters in the pockets of the bit body. The novel process involves coating the entire drill bit, with the cutters in place, with Teflon. Teflon is the registered trademark of DuPont de Nemours, E.I., Company of Wilmington, Del. for the product tetrafluoroethylene (TFE). The reason for using the Teflon is that Teflon is impervious to many acids, including hydrofluoric acid. This is contrasted with the inability of most containers, including those made from glass, to contain hydrofluoric acid, an acid which will go right through most containers, but will not go through a layer of Teflon. The preferred acid for the leaching bath according to the present invention is a 50/50 mix of hydrofluoric acid and nitric acid.

There are various other components of the drill bit which need to be protected from the Teflon coating, including the threaded ports at the bottom of the bit into which nozzles are typically threaded into. These nozzle ports can be protected by threading a plug into each of the nozzle ports to keep the Teflon from coating the threads themselves.

In using the process of the invention, the entire bit, with the PDC cutters in place in the pockets in the bit, is then coated with Teflon. One or more edge segments or portions of the cutter to be leached can be scraped off leaving no Teflon on that surface. This will typically be the cutting edge of the cutter. After the selected portion of the Teflon is removed, the entire drill bit itself can be immersed or sprayed or soaked to cause the acid to come into contact with the portion of the cutter which is now uncoated by removing the Teflon. The acid will thereby leach the selected portion of the cutter, or all of the cutters for that matter, to result in much stronger cutters. They have the advantage of the cobalt remaining in the rest of the cutter. Only that portion of the cutter, which is to be pressed against the rock being drilled, is leached.

Hydrofluoric acid (HF) is highly corrosive and will corrode most substances other than lead, wax, polyethylene, Teflon and platinum. Although the preferred coating material used with this invention is Teflon, the second most preferred would be to provide a coating of polyethylene. It is well known that hydrofluoric acid is extremely corrosive and is used for many purposes but its unique properties make it significantly more hazardous then many of the other acids used in laboratories.

In the preferred embodiment of the invention, which contemplates the use of a 50/50 mix of hydrofluoric acid and nitric acid, the acid leach works much more efficiently at elevated temperatures, for example, at approximately 800-850° F. If a single PDC cutter is being leached, the cutter after being coated with Teflon can be immersed into a bath of the 50/50 acid mix and is preferably done under a fume hood to protect the personnel working with the process. Prior to the one or more cutters being immersed in the 50/50 acid mix, they are first coated with the Teflon and then allowed to dry so the Teflon coating is firmly in place. The cutting edge of the PDC cutter can then be selectively removed such as one would scrap off, or grind off, the Teflon along a given edge of the cutter. This is illustrated in FIG. 3 to expose the uncoated cutting edge 400 of the PDC cutter 402. The PDC cutter 402 of FIG. 3 has a top end surface 408, a circular cutter edge 401, a diamond layer 404 and a substrate 406. The coated PDC cutter 402, having one or more selected portions 406 of the cutting edge 401 cleared free of Teflon, are then immersed into the 50/50 acid mix for times sufficient to leach to depths, typically short of the substrate 406, which are dependent upon the length of time the cutters are immersed in the hot 50/50 acid mix, and then are removed from the 50/50 acid mix and cleaned from the acid mix residue left on the PDC cutters after they are removed from the acid bath.

In the preferred embodiment of the invention, which contemplates the use of a 50/50 mix of hydrofluoric acid and nitric acid, the acid leach works much more efficiently at elevated temperatures, for example, at approximately 800-850 degrees Fahrenheit. If a single PDC cutter is being leached, the cutter after being coated with Teflon can be immersed into a bath of the 50/50 acid mix and is preferably done under a fume hood to protect the personnel working with the process. Prior to the one or more cutters being immersed in the 50/50 acid mix, they are first coated with the Teflon and then allowed to dry so the Teflon coating is firmly in place. The cutting edge of the PDC cutter can then be selectively removed such as one would scrape off, or grind off, the Teflon along a given edge of the cutter. This is illustrated in FIG. 3 to expose the uncoated cutting edge 400 of the PDC cutter 402. The PDC cutter 402 of FIG. 3 has a top end surface 408, a circular cutter edge 401, a diamond layer 404 and a substrate 406. The coated PDC cutter 402, having one or more selected portions 400 of the cutting edge 401 cleared free of Teflon, are then immersed into the 50/50 acid mix for times sufficient to leach to depths, typically short of the substrate 406, which are dependent upon the length of time the cutters are immersed in the hot 50/50 acid mix, and then are removed from the 50/50 acid mix and cleaned from the acid mix residue left on the PDC cutters after they are removed from the acid bath.

Figure 5:
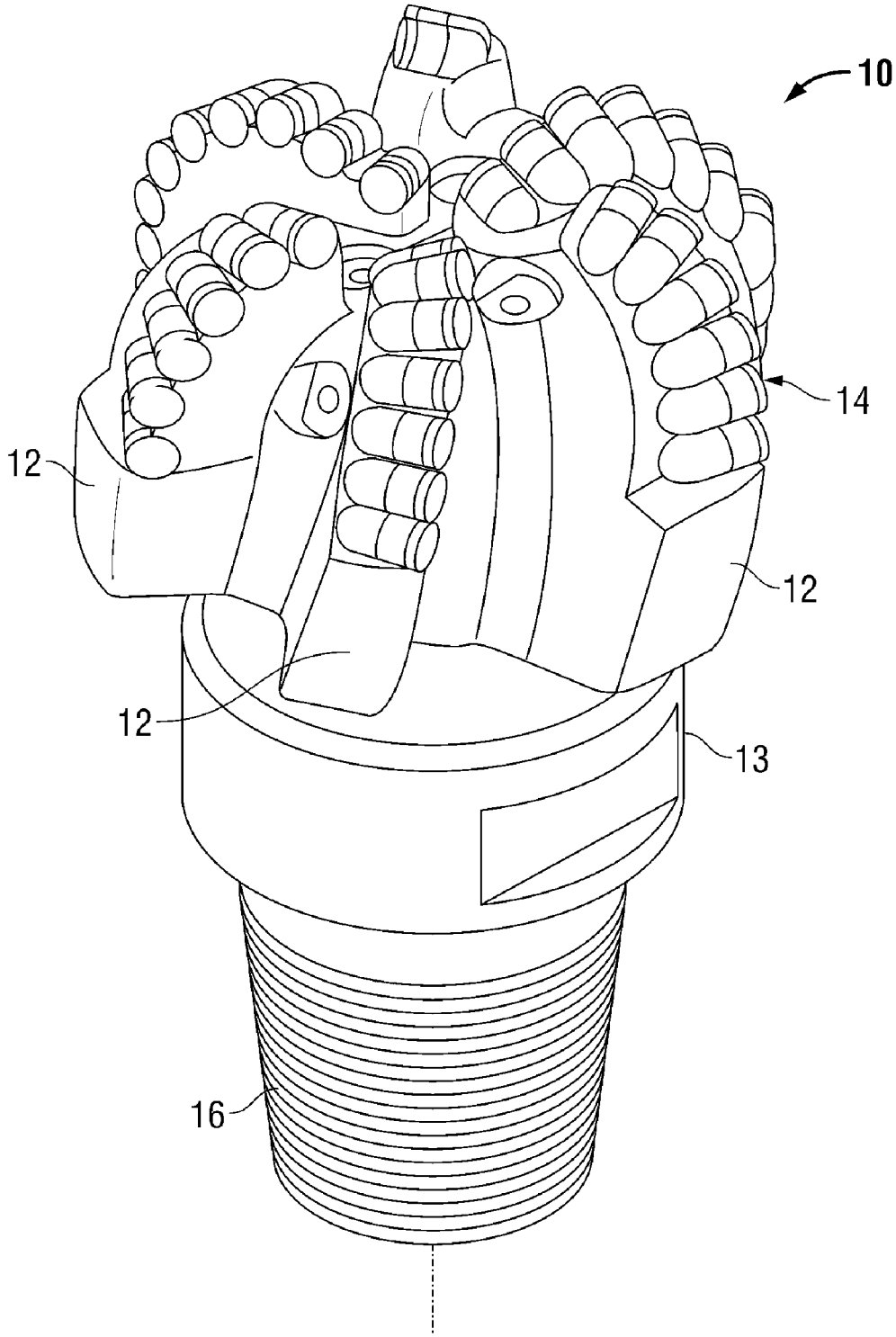
FIG. 5 (Prior Art)
FIG. 5 is an elevated, pictorial view of a known PDC drill bit having drill bit cutters mounted therein.

FIG. 5 is a PDC drill bit, known in the prior art 10, having a plurality of wear gage pads 12, a plurality of PDC cutters 14, a shank 13 and a threaded pin end 16 for connection into a drill string (not illustrated).

The cutters of the drill bit having the PDC cutters 14 (FIG. 5) already in place within the drill bit surface, are first coated with the Teflon. As soon as the Teflon coating has dried, a selected portion or portions of the cutting face of the individual cutters can be selectively removed, such as by scraping, grinding or buffing the edges to remove the Teflon coating in those selected cutting edge portions.

In using the first embodiment above described, the individual cutters, after being selectively leached as above described, can be oriented within the pre-existing sockets in the drill bit itself, such that the selectively leached portions of the cutter can be rotatedly oriented with respect to where they need to be when they are going to be drilling through rock, such as drilling an oil and gas well. This orientation of the cutters is well known in this art.

With the alternative embodiment of selectively leaching the cutters after they are already in place in the drill bit, the cutters are already oriented with respect to which portions should be leached based upon what portions of the rock they will be cutting.

Figure 4:
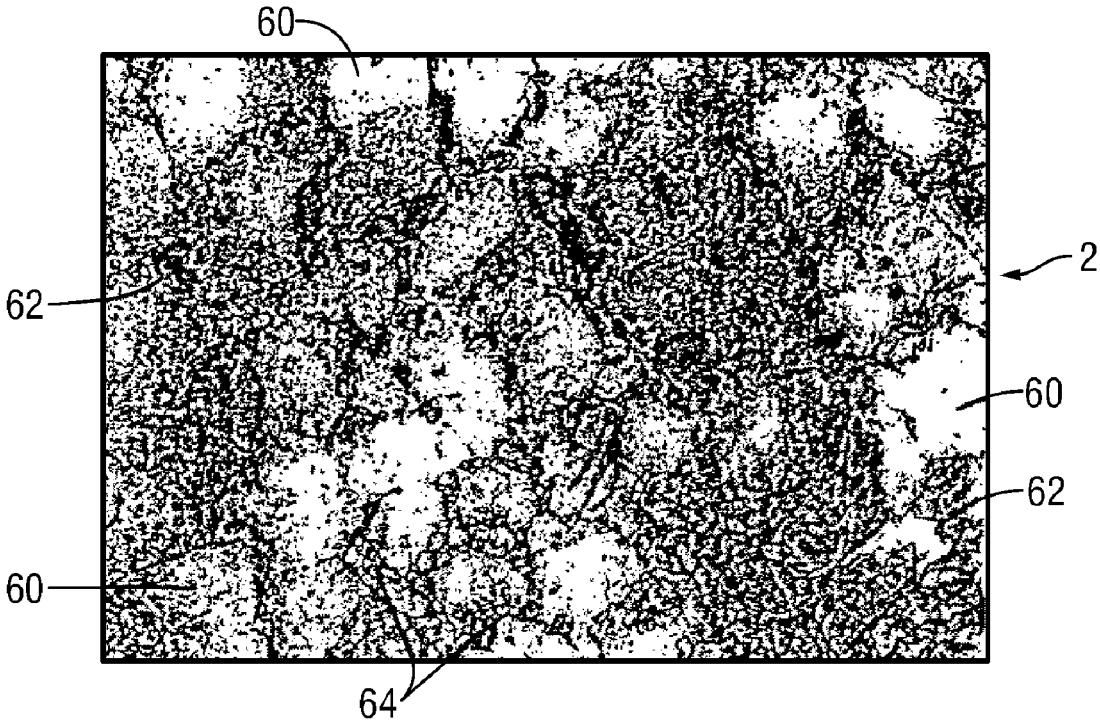
FIG. 4 is a second cutaway illustration of a portion of the diamond crystal structure used in a PDC cutter.

During manufacture, under conditions of high-temperature and high-pressure, the interstices 62 of FIGS. 2 and 4 among the crystals 60 fill with the catalyzing material 64 just as the bonds among the crystals 60 are being formed.

The interstitial matrix 68 contains the catalyzing material 64. The PDC element 2 may be bonded to a substrate 6 of FIG. 1 or 406 of FIG. 3 of less hard material, usually cemented tungsten carbide, but use of a substrate is not required.

Referring now to the photo-micrograph of a prior art PDC element in FIG. 4, and also the microstructural representation of a PDC element of the prior art in FIG. 2, it is well known that there is a random crystallographic orientation of the diamond or diamond-like crystals 60 as shown by the parallel lines representing the cleavage planes of each crystal 60. As can be seen, adjacent crystals 60 have bonded together with interstitial spaces 62 among them. Because the cleavage planes are oriented in different directions on adjacent crystals 60 there is generally no straight path available for diamond fracture. This structure allows PDC materials to perform well in extreme loading environments where high impact loads are common.

In the process of bonding the crystals 60 in a high-temperature, high-pressure press, the interstitial spaces 62 among the crystals 60 become filled with a binder-catalyzing material 64. It is this catalyzing material 64 that allows the bonds to be formed between adjacent diamond crystals 60 at the relatively low pressures and temperatures present in the press.

The prior art PDC element has at least one continuous matrix of crystals 60 bonded to each other with the many interstices 62 containing a binder-catalyzing material 64, typically cobalt or other group VIII element. The crystals 60 comprise a first continuous matrix of diamond, and the interstices 62 form a second continuous matrix of interstices known as the interstitial matrix 68, containing the binder-catalyzing material.

Edge Leaching Process

This present invention outlines methods for producing a PDC bit with temperature resistant abrasive compacts. To date, alt bits utilizing these type compacts have been built using traditional leaching methods, i.e., teaching the entire diamond table or a majority of it. In sharp contrast, these methods according to the present invention involve the treating of the compacts edge only, which is the part of the cutter doing majority of the actual drilling. It is an important feature of the present invention that only the one or more cutting edges can be leached, thus leaving the center portion of the end face of the PDC cutter more impact resistant.

It is common practice in the prior art to leach cobalt from PDC cutters and then install them into a bit. This process involves highly concentrated acids (nitric, sulfuric and hydrofluoric) raised to near their boiling point. The PDC cutters are then placed in a bath of one of these acids, diamond-side down, with their LS bond and substrate material protected by nitrile rubber or some similar highly acid-resistant material that can tolerate these high temperature fluids. Man-made synthetics, such as Hypalon®, Viton®, and similar compounds are also possible substrate coating materials. This prior art process treats the entire diamond surface. Patents exist which designate specific leaching depths, and these all address treating the entire compact, and are based on depth from the face of the diamond surface.

When drilling, only the downward oriented edge of any PDC cutter is doing work. Maintaining the integrity of this sharp drilling edge is the focus of the prior art leaching treatment. Because the cutters are round, and their installation orientation uncertain, the entire PDC layer is leached. And yet when this drilling edge is worn down by abrasive formations, these full-face leached cutters fail nearly as rapidly as non-leached cutters due to heat generation on the large wear flat of the PDC cutter. They are also more fragile with respect to impact than non-leached cutters.

From a practical standpoint, in truly abrasive rock formations, full-face leached cutters also wear and develop a wear flat, which is usually large enough that the compact cannot be rotated for repair. This means the cutter is now essentially useless, even though it has an expensive chemical treatment across the entire diamond table. Often times, portions of cutters are never used due to large wear flat development, which often extends into the cutter pocket in highly abrasive formations. The current invention selectively applies the edge leaching treatment only to the area that is intended for drilling on each compact.

In the methods according to the present invention, a fully completed diamond compact is leached in such a manner that only one or more portions of the peripheral edge of the diamond table is leached, This is logical, as the full-face leaching treatment is done to improve wear resistance, yet it is the failure of the drilling edge of the compact that induces and begins development of the wear fiat, which in turn causes the eventual failure of the entire compact. By leaching only a portion of the periphery of the diamond table, the volume of diamond requiring treatment is reduced. Additionally, the untreated remainder of the diamond table retains its original characteristics, which include higher impact resistance than full-face leached compacts.

By creating a dimple, scratch or other physical surface indicator on the surface of the cutter, the leached portion of the compact edge can be readily identified. This allows for easy placement of the cutter in the preferred orientation for drilling with a bit.

It is well documented within the chemical industry that polytetrafluoroethylene is resistant to all acids. It has also been used to coat under reamers, stabilizers and drill bits in an effort to inhibit bit balling. The preferred method would coat the compact with polytetrafluoroethylene, polyethylene, polyvinylchloride, chlorosulphonated polyethylene, nitrile rubber or other similar, highly acid-resistant materials to prevent chemical reaction to the acid, but most preferably, with polytetrafluoroethylene (Teflon).

Once covered with the protecting coating or skin, the selected edge of each PDC cutter is exposed by scraping, cutting or abrading the protective, acid-resistant skin away. This allows a portion of the compact to be exposed to highly concentrated acid without causing a reaction to the majority of the diamond table and peripheral edge. Only the selected portion or portions of the actual drilling edge of the PDC cutter are exposed to the leaching process.

This protective coating or skin (referred to as skin from here on) allows the compact to be introduced into an acid bath, and thus leach only the exposed portion of the edge according to the present invention.

Figure 6A:
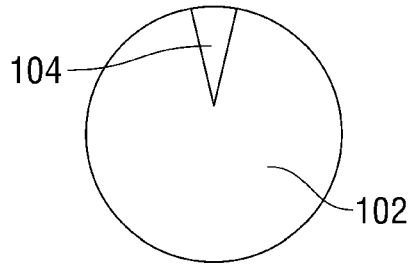
FIGS. 6A, 6B and 6C are top plane views having a single segment, a pair of segments and a trio of segments, respectively, of the PDC cutter face being selectively leached according to the invention.

In an alternative embodiment of the invention, similarly, a mechanical shell-like device, engineered to be used as an outer shell on the cutter and sealing all but the desired edge from the exposure cycles, works to protect the remainder of the cutter. In this regard, FIGS. 6A, 6B, 6C, 7A and 7B illustrate this alternative embodiment of the present invention. FIG. 6A illustrates a top plan view of PDC cutter 100 having a top end surface 102 and a top segment 104. FIG. 7A illustrates an optional segment 106 in the side surface 108 of the diamond layer 108. When used the segment 106 is contiguous with the segment 104 as illustrated in FIGS. 6A and 7A. The coating or skin has been removed from the segments 104 and 106. The PDC cutters 100 in FIG. 7A or 7B are identical other than for the number of segments being leached.

Figure 6B:
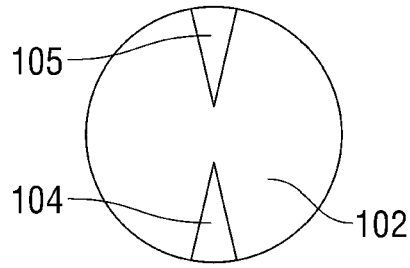
Figure 7A:
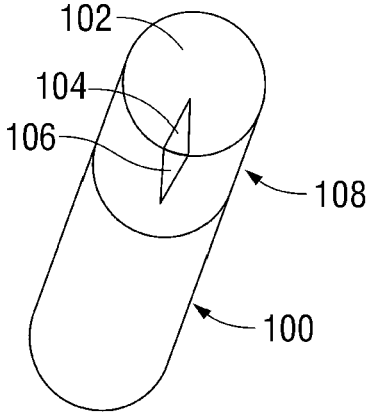
FIGS. 7A and 7B are each isometric, pictorial views of a PDC cutter of the PDC cutter face having one or more segments of the PDC cutter face and one or more segments of the PDC side surface, respectively, being selectively leached according to the invention.
Figure 7B:
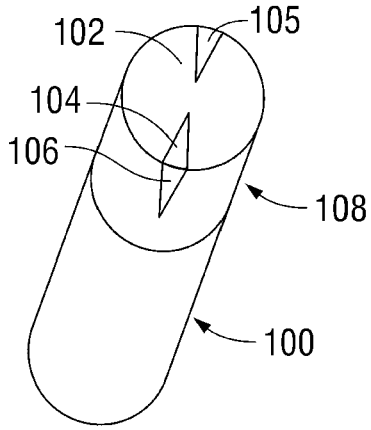

In FIG. 6B, the end surface is illustrated as having first and second edge segments 104 and 105, each leached in accordance with the invention. FIGS. 6B and 7B each have a contiguous segment in the side surface 108 which are not visible in these two views.

Figure 6C:
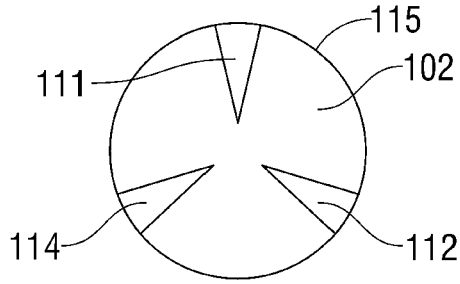

Similarly, FIG. 6C has three segments, equispaced around the peripheral edge 115 which are leached in accordance with the invention.

The invention thus contemplates drilling a well with the segment 104, 106 of the cutter 100 of FIG. 7B, pulling the bit out of the well, removing the cutter 100, and rotating the cutter 100 to now drill with the segment 105 and its unnumbered contiguous segment.

Similarly, the cutter having the end face 102 of FIG. 6C can be used to drill with one of the segments 111, 112 or 114, and rotated twice to drill with the two remaining segments.

Figure 8A:
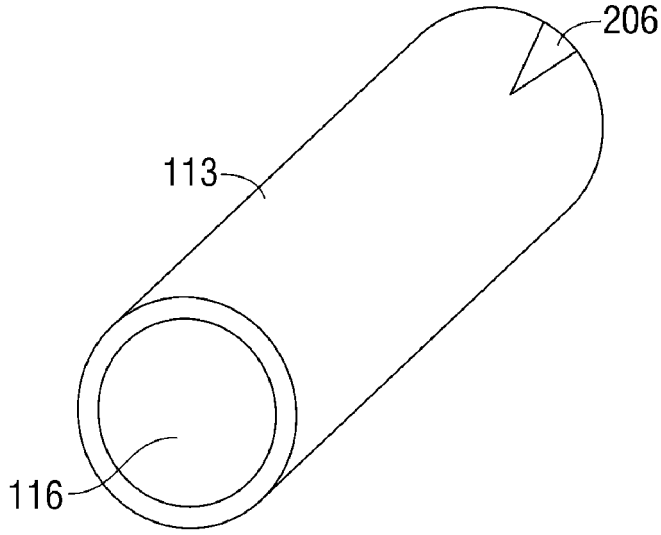
FIG. 8A is an isometric, pictorial view of a tube having one or more templates in the end cap of the tube and one or more templates in the side cutting surfaces, thus allowing an acid mix to be selectively applied to a PDC cutter according to the invention.
Figure 8B:
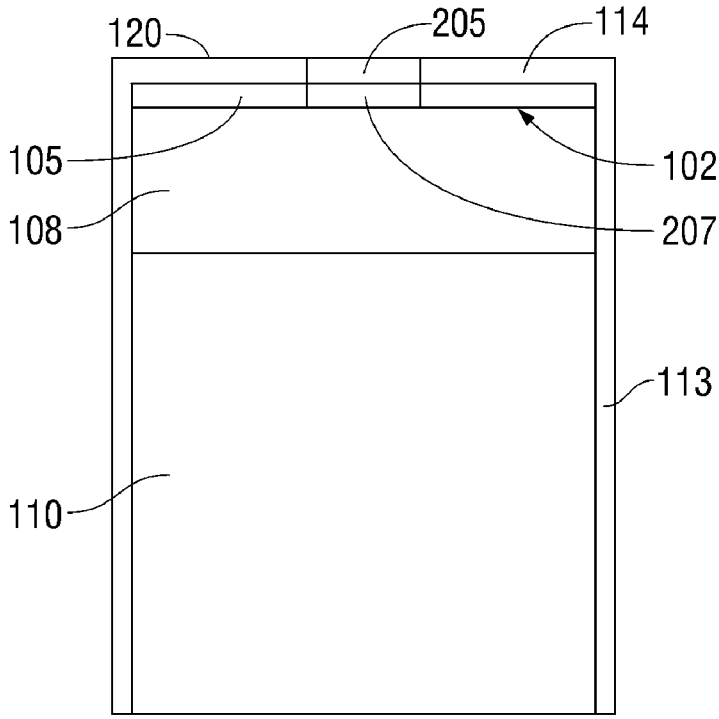
FIG. 8B is an elevated view, partly in cross section, of a mechanical shield tube according to FIG. 8A, in place over a PDC cutter.
Figure 9:
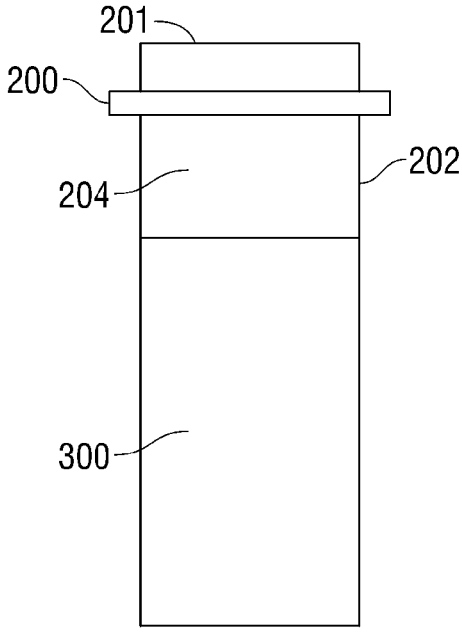
FIG. 9 (Prior Art)
FIG. 9 is an elevated view of a PDC cutter, illustrating a rubber o-ring in place over the diamond layer in a known leaching process.

An alternative embodiment of the invention is illustrated in FIGS. 8A and 8B uses a mechanical shield, in lieu of coating the PDC cutter with Teflon, polypropylene or the like, to allow the acid bath to contact only the selected segment or segments of the side surface and/or top end surface of the diamond layer of the PDC cutter. This approach is in sharp contrast to the prior art approach illustrated in FIG. 9, in which the entire top end surface 201 of the diamond layer 204 is immersed in an acid bath, and a rubber o-ring 200 is positioned on the side surface 202 to limit the acid bath from contacting the side surface 202 below the o-ring 200 or the substrate 300.

Figure 10:
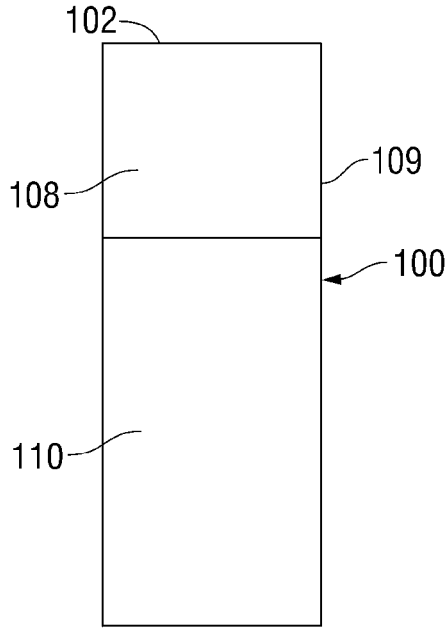
FIG. 10 is an elevated view of a PDC cutter as is used in the selective leaching processes according to the invention.

In the operation of the alternative embodiment according to FIGS. 8A and 8B, one starts with a conventional PDC cutter 100 such as is illustrated in FIG. 10, having a diamond layer 109 formed on a substrate 110, with a top end surface 102 and a side surface 108. A hollow tube 113, illustrated in FIG. 8A, having an open end 116 and a closed end, is positioned over the exterior of the cutter 100 as illustrated in FIG. 10. The tube 113 is dimensioned to fit snugly over the exterior surfaces of the cutter 100. The tube 113 is preferably fabricated from Teflon or polypropylene or any other material which is impervious to the leaching acid being used. Alternatively, the tube 113 can be of some other material, for example, from plastic or metal, and be covered with Teflon or polypropylene or the like, preferably to be impervious to acid.

As illustrated in FIG. 8B, a gasket 105, preferably fabricated from Teflon or polypropylene or any other material impervious to the acid being used, is attached to the top end surface 102 of the cutter 100 prior to the tube 113 being put in place over the cutter 100. Alternatively, the gasket 105 can be attached to the underside surface of the end cap 114.

A pair of matching templates are aligned, a template 207 in the gasket 105 and a template 205 in the end cap 114 of the tube 113, to allow the acid to pass through the end cap 114 and the gasket 105 to thus come into contact with the diamond layer 108 and commence the leaching process. The template 206 of FIG. 8A in the tube 113 is not visible in FIG. 8B, but is contiguous to the templates 204 and 207.

After a predetermined time, the leaching process is stopped by removing the tube 113 from the cutter 100 subsequent to the tube 113 and the cutter 100 being removed from the acid bath.

Figure 11:
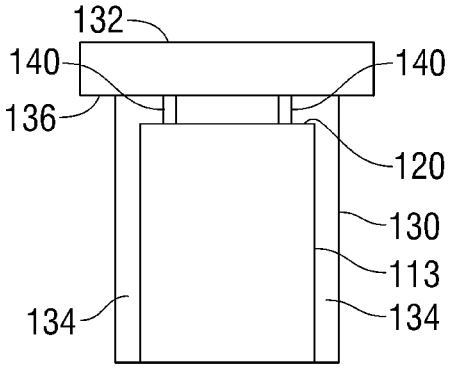
FIG. 11 is an elevated schematic view of an acid bath enclosure which is used to selectively leach one or more segments of a PDC cutter according to the invention.

The operation of the embodiment of FIGS. 6A-C, 7A, 7B, 8A and 8B also involves the use of an acid bath in FIG. 11 in which the tube 113 and the PDC cutter 100 can be immersed. The chamber 130 has a volume of leaching acid 134 therein, described herein with respect to the other embodiments of the invention, into which the tube 113 and the cutter 100 are lowered. The chamber 130 and its threaded on cap 132, are dimensioned such that one or more legs 140 extending from the lower surface 136 of the cap 132 are gently pushed against the top surface 120 of the tube 113 as the cap 132 is threadedly screwed onto the chamber 130. Because of the stand off achieved by the legs 140, the acid 134 can flow over the top surface 120 of the tube 113 and into the one or more templates leading to the diamond layer 108.

Thus, the tube 113 can have one, two, three or more templates in its end cap 114, and a corresponding number of side surface templates, to enable, for example, the leaching of the segments illustrated in FIGS. 6A, 6B, 6C, 7A and 7B.

Figure 12:
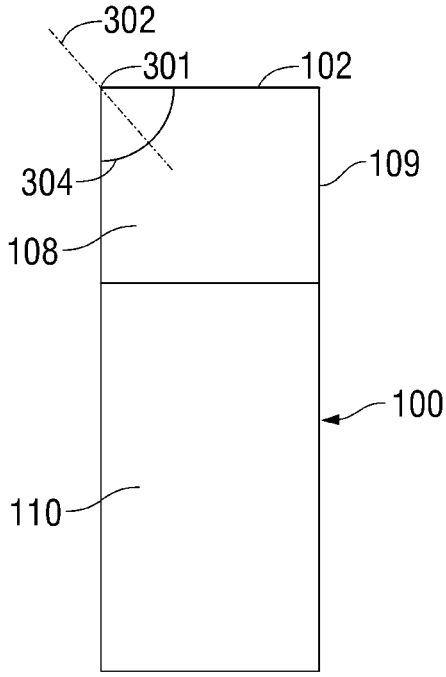
FIG. 12 is an elevated schematic view of a PDC cutter being selectively leached according to the invention.

The gaskets used will have a corresponding number of templates, spaced to align with the templates used in the end cap. Thus, those skilled in this art will recognize that one, two, three or more templates can be used in the end cap of the tube 113. When using the one or more templates to leach the PDC cutter edge 301 of FIG. 12, the leaching process is vectored along the dotted line 302 to various depths delineated by the curved line 304. When using the one or more templates in the side wall of the tube 113, the side wall template will be contiguous to its corresponding template in the end plate of the tube 113; for example, as illustrated in FIGS. 7A and 7B.

Figure 13A:
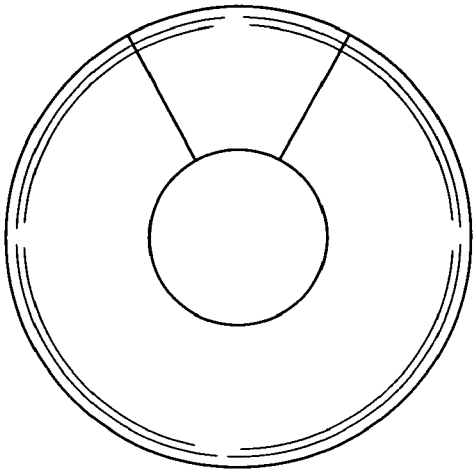
FIGS. 13A and 13B are a top plan view and a side view, respectively, of one embodiment of a leaching segment according to the invention using a regular spacing.
Figure 13B:
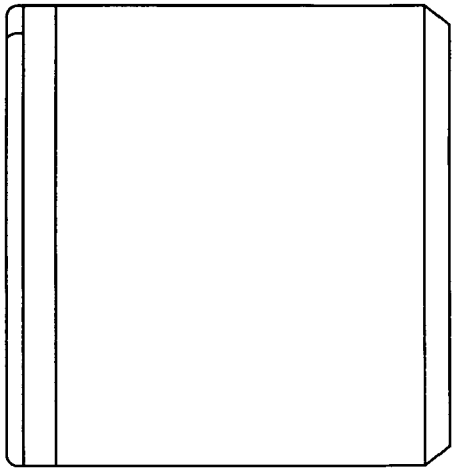
Figure 14A:
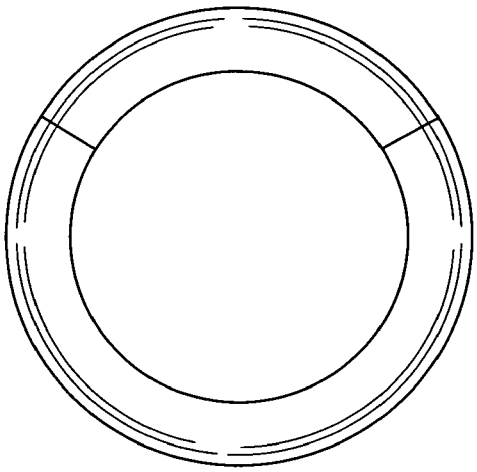
FIGS. 14A and 14B are a top plan view and a side view, respectively, of a second embodiment according to the invention using a long spacing.
Figure 14B:
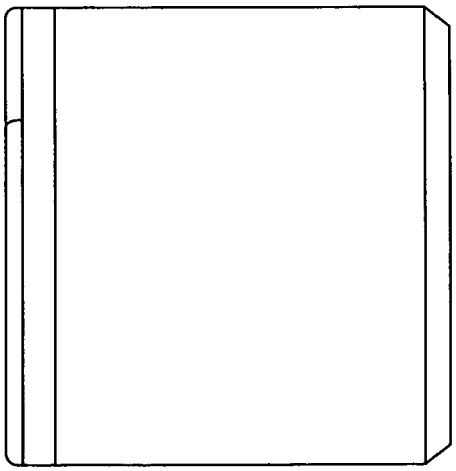

It should be appreciated that the templates in the mechanical shell or tube, the templates as are achieved by removing segments of the coating, i.e., the skin, and the templates in the gasket, may be of any number, i.e., one, two, three or more as desired, and may be of any shape as desired. The shape used in the segments of FIGS. 6A, 6B, 6C, 7A and 7B, as well as those used for the templates 8A and 8B and for the templates used in FIGS. 13A and 13B, and in FIGS. 14A and 14B are merely exemplary and the shapes can be any shape as desired. For example, the shapes can be round, circular, semi-circular, triangular, square, rectangular, etc.

For example, instead of the tube 113 illustrated in FIG. 8A, the invention contemplates the use of a clamshell such as illustrated in FIGS. 15A, 15B, 15C and 15D to provide a mechanical shield over the PDC cutter. The clamshell 500 each of these four figures illustrate a PDC cutter 502 having a substrate 504 and a diamond crystal upper layer 506. The clamshell mechanical shield itself has a lower body 508 and an upper plate 510.

A gasket (not illustrated) can be used, if desired, between the plate 510 and the top surface of the diamond layer 506, and a second gasket (not illustrated) can be used, if desired, between the plate 510 and the lower body 508. The plate 510 is bolted to the lower body 508 through the holes 512.

Figure 15A:
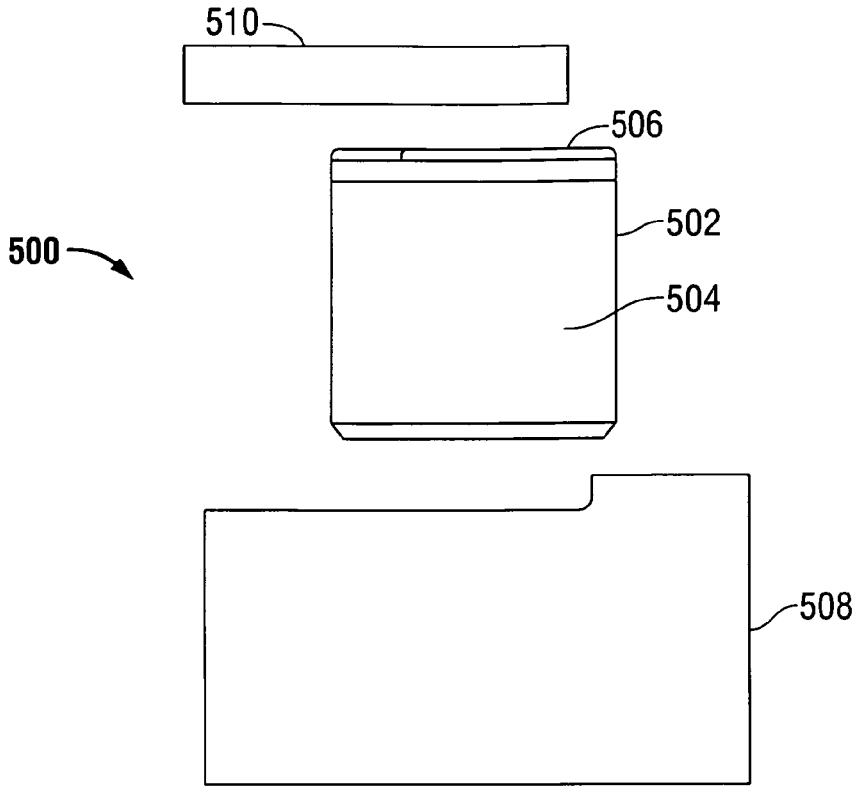
FIGS. 15A, B, C and D are isomeric views of an alternative embodiment of a mechanical shield according to the invention.
Figure 15B:
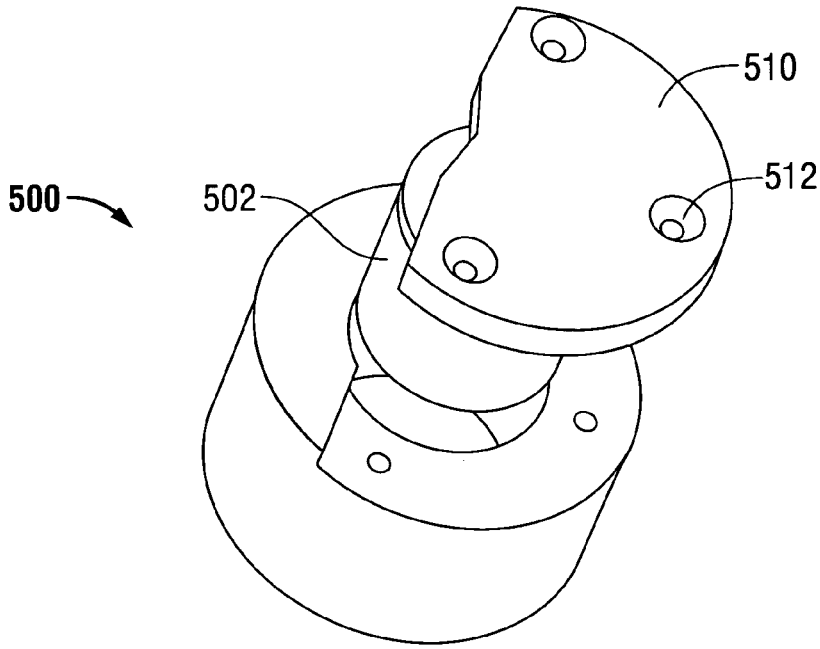
Figure 15C:
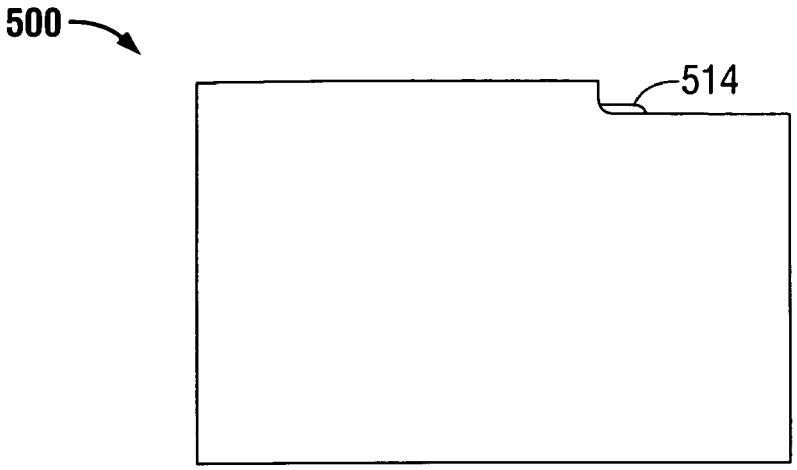
Figure 15D:
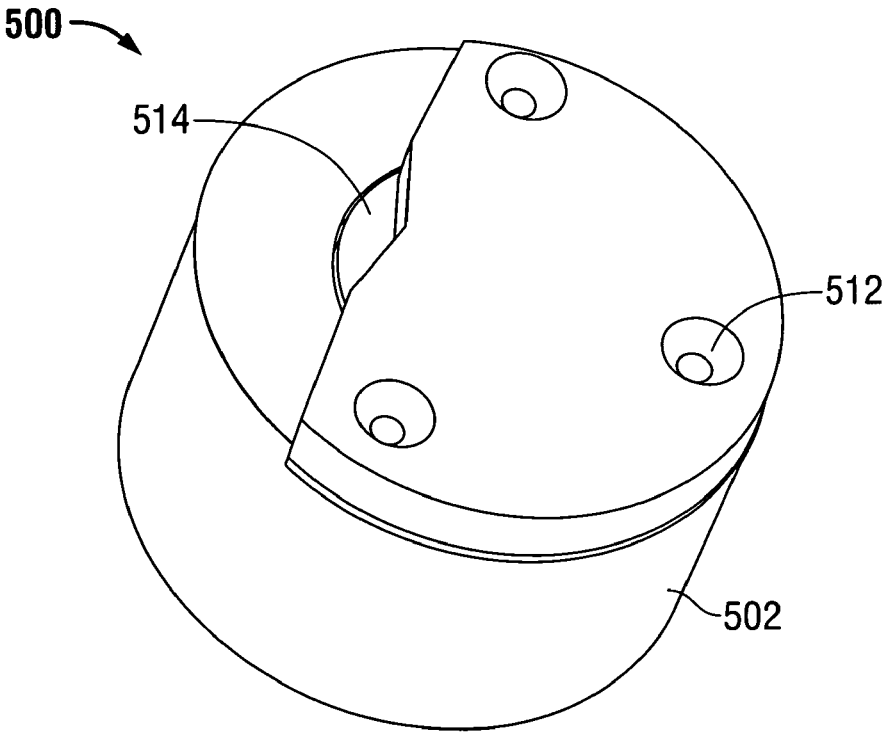

In using the mechanical shield 500, the PDC cutter 502 is placed within the lower body 508, and then held in place by the upper plate 510. Once the plate 510 is bolted onto the lower body 508, only the segment 514 of the diamond layer is exposed for applying the leaching acid, thus providing a leaching of the exposed cutting edge of the segment 514 as illustrated in FIGS. 15C and 15D. The design of the clamshell 500 can, of course, be modified to expose two or more segments of the PDC cutter to the acid mix, as desired.

The leaching process is halted before the diamond layer loses its integrity. Processing should be timed and set up so that cobalt leaching does not occur too near the diamond/substrate interface. In most cases there is a full or partial cobalt interlayer remaining from the diamond manufacturing process near the bond zone. The process avoids leaching a large pool or inclusion of cobalt catalyst and destabilizing the diamond/substrate bond itself. Severe processing could also lead to failure of the diamond/substrate bond from a lack of eutectic characteristics provided by the remaining cobalt catalyst.

For compacts with larger mesh diamond grains (50-100 p), leaching depth should preferably not exceed 2 times the predominant grain size in distance away from the diamond/substrate bond line. For medium mesh diamond grains (20-50 p), this distance should be 3-4 times predominant grain size. For finer grain sizes, this depth should be 5-7 times predominant grain size. All the above distances should be increased within the specified range as the grain size declines, and decreased as the grain size becomes larger. These are maximum leaching depth options, but the process accommodates shallower leaching options as well.

The exposed area should be along the peripheral edge of the diamond table. It may encompass most of the peripheral edge, and extend inwards to the center of the cutter, but in all cases it does not include 100 % of the end surface of the diamond table. Discontinuous segments of the periphery may be processed, or opposed sections. But in all cases, only a portion of the surface of the diamond table is leached. FIGS. 13 and 14 illustrated a pair of many possible edge leaching options, FIGS. 13A and 13B being a template for "regular" spacing and FIGS. 14A and 14B being a longer spacing.

Other Advantages of the Process

Prior art leaching processes work on the diamond layer of the entire PDC cutter. In sharp contrast, this inventive process is designed to work on the drilling edge only, the actual part of the PDC cutter which performs work. This smaller total surface area reduces the required exposure times, and possibly even the required concentrations of the leaching acid(s).

By leaching the edges of a compact rather than the entire diamond table, the remainder of each diamond table retains its manufactured characteristics. This normally includes higher impact resistance due to the cobalt remaining in the diamond matrix.

As the cutters are coated with acid resistant skin or enclosed in an acid-proof clamshell protector, they can easily be batch processed by placing them in a trough with the exposed diamond edges inside the trough. Acid can then be run through the trough, minimizing required acid volume and reducing potential exposure of personnel to large quantities of acid and acid vapors.

Used cutters which are worn but do not exhibit significant enough wear flat to prevent reuse can be treated easily with this process.

By processing 180° opposed segments (using a clam-shell protective device with two exposed openings, or scratching away the skin on two opposed edges), a cutter is rotated for repair provided the segment opposite the drilling edge is not damaged. Obviously, a 3-sided option stems from this line of thought, as does a 4-sided option or more.

By utilizing a multi-sided, segmented treatment, cutters are placed across a bit with either processed edge or unprocessed edge contacting the formation. This allows for many different options in designing a bit to accommodate differing formations.

The invention contemplates the construction of a compact which has a small segment of non-leached edge flanked by two segments of leached edge. This allows the initial drilling edge to be more impact resistant for drilling impact prone formations. Once this edge has worn away, the flanking segments come into play for more abrasive formations. The converse is also true.

By combining the above options, many different types of formation are accommodated with a single bit, depending upon how the cutters were plotted or "laid out" in a bit design.

The primary process allows for complex cutter shapes to be easily treated, as it involves a coating process which does not require a uniform shape to seal it protectively.

The invention claimed is:

1. In a method for improving the performance of a PDC drill bit having a plurality of PDC cutters mounted therein, comprising the steps of:

coating the exterior surface of said drill bit and the exterior surface of at least one of said plurality of PDC cutters, each of said PDC cutters having a body of diamond crystals and a catalyzing material contained within said body, said coating comprising a material impervious to a given acid or a mixture of given acids;

selectively removing a segment of said coating from said at least one PDC cutter;

applying said given acid or mixture of given acids to said at least one PDC cutter to leach out at least some of the catalyzing material contained within said body of diamond crystals, thereby providing improved thermal stability to a first region of said at least one PDC cutter from which said coating has been removed while retaining improved impact strength within a second region of said at least one PDC cutter upon which said coating has been retained.

2. The method of claim 1, wherein said coating comprises tetrafluroethylene.

3. The method of claim 1, wherein said coating comprises polyethylene.

4. The method according to claim 1, wherein said acid comprises hydrofluoric acid.

5. The method according to claim 1, wherein said given mixture of acids comprises a mixture of hydrofluoric acid and nitric acid.

6. The method according to claim 1, wherein said catalyzing material comprises cobalt.

7. The method according to claim 1, wherein said catalyzing material consists essentially of either cobalt, nickel, iron, or alloys thereof.

8. The method of claim 1, further comprising the step of heating the drill bit to facilitate leaching of said at least one PDC cutter, wherein the said given acid or mixture of given acids is heated by the drill bit when applied to said at least one PDC cutter.

9. The method of claim 1, wherein the step of selectively removing a segment of said coating from said at least one PDC cutter comprises removing said coating from at least a portion of a cutting edge of said at least one PDC cuter while retaining said coating on the remainder of said at least one PDC cutter.

10. A PDC bit having a plurality of PDC cutters mounted therein, each of said PDC cutters having a first end comprising a layer of diamond crystals and catalyzing material contained within the interstices between said diamond crystals respectively, said first end of said bodies comprising a circular cutting edge for drilling through rock;

a coating covering the external surface of each of said layers of diamond crystals, said coating comprising a material which is impervious to a given acid or a mixture of given acids, at least one of the PDC cutters having a template through its coating exposing one or more segments of the cutting edge for such at least one PDC cutter, for introducing said given acid or mixture of given acids through said at least one template to thereby leach out some of the catalyzing materials contained within the interstices between said diamond crystals and thereby provide improved thermal stability to a first region of said at least one PDC cutter exposed through said template while retaining improved impact strength within a second region of said at least one PDC cutter covered by said coating.

11. The PDC drill bit of claim 10, wherein said coating comprises tetrafluroethylene.

12. The PDC drill bit of claim 10, wherein said coating comprises polyethylene.

13. The PDC drill bit according to claim 10, wherein said given acid comprises hydrofluoric acid.

14. The PDC drill bit according to claim 10, wherein said mixture of given acids comprises a mixture of hydrofluoric acid and nitric acid.

15. The PDC drill bit of claim 10, wherein said catalyzing material comprises cobalt.

16. The PDC drill bit of claim 10, wherein said catalyzing material consists essentially of cobalt, nickel, iron, or alloys thereof.

* * * * *